US005514290A

United States Patent [19]

Donofrio et al.

[11] Patent Number: 5,514,290

[45] Date of Patent: May 7, 1996

[54] HYDROXYARYL/PHOSPHONATE-DERIVED AMINOALKANOL BORATES AS MULTIFUNCTIONAL ANTIWEAR/EP LOAD-CARRYING ADDITIVES

[75] Inventors: John R. Donofrio, Mullica Hill; Liehpao O. Farng, Lawrenceville; Andrew G. Horodyksy, Cherry Hill, all of N.J.

[73] Assignee: Mobil Oil Corporation, Fairfax, Va.

[21] Appl. No.: 324,328

[22] Filed: Oct. 17, 1994

Related U.S. Application Data

[63] Continuation of Ser. No. 949,945, Sep. 24, 1992, abandoned.

[51] Int. Cl.[6] ..... C10M 155/04; C10M 139/00

[52] U.S. Cl. ..... 252/49.9; 568/2

[58] Field of Search ..... 252/49.9; 568/2

[56] References Cited

U.S. PATENT DOCUMENTS

| | | | |
|---|---|---|---|
| 4,529,528 | 7/1985 | Horodysky | 252/49.6 |
| 4,557,844 | 12/1985 | Horodysky | 252/49.9 |
| 4,563,299 | 1/1986 | Frangatos | 252/49.9 |
| 4,755,311 | 7/1988 | Burjes et al. | 252/49.9 |
| 4,965,002 | 10/1990 | Brannen et al. | 252/49.9 |
| 5,077,329 | 12/1991 | Pastor et al. | 252/49.9 |

*Primary Examiner*—Margaret Medley
*Attorney, Agent, or Firm*—Malcolm D. Keen; Dennis P. Santini; Charles A. Malone

[57] ABSTRACT

Hydroxyaryl/phosphonate-derived aminoalkanol mixed borates have been found to be effective multifunctional load-carrying additives for lubricants.

9 Claims, No Drawings

HYDROXYARYL/PHOSPHONATE-DERIVED AMINOALKANOL BORATES AS MULTIFUNCTIONAL ANTIWEAR/EP LOAD-CARRYING ADDITIVES

This is a continuation of application Ser. No. 07/949,945 filed on Sep. 24, 1992 which is now abandoned.

BACKGROUND OF THE INVENTION

1. Field of the Invention

This application is directed to hydroxyaryl/phosphonate-derived aminoalkanol mixed borates as effective multifunctional load-carrying additives for lubricants and to lubricant compositions containing same.

2. Description of Related Art

The use of phosphonate compositions, such as dibutyl hydrogen phosphonate (dibutyl phosphite) and dinonylphenyl hydrogen phosphonate, has found widespread commercial use in lubricating oils as multifunctional antiwear/EP additives.

The use of hydroxyaryl compositions, such as phenol, alkylated phenols, hydroquinone, alkylated hydroquinones, catechol, alkylated catechols, resorcinol, alkylated resorcinols, has been well known for their thermal/oxidation stabilizing properties in a variety of lubricant, polymer, and elastomer applications.

The use of borate esters has been widely reported as having beneficial multifunctional friction reducing properties.

The use of aminoalkanols has found widespread commercial use as surface active agents, detergents and/or corrosion inhibitors in many application areas.

It has now been found that the use of these hydroxyaryl/phosphonate-derived aminoalkanol borates provides exceptional antiwear and activity with potential anti-fatigue, anti-oxidation/high temperature stabilizing, and corrosion inhibiting properties. To the best of our knowledge, this unique integration of four beneficial functional groups together to enhance their overall effectiveness as lubricant additives has not been previously reported.

BRIEF SUMMARY OF THE INVENTION

An object of this invention is to provide additive products having superior and/or improved multifunctional characteristics for lubricant compositions. A further object is to provide improved lubricant compositions comprising such additive products.

It has been found that lubricant compositions containing small additive concentrations of hydroxyaryl-phosphonate derived aminoalkanol mixed borates possess excellent antiwear properties coupled with very good extreme pressure, load-carrying activities. Both the phosphonate moiety, aminoalkanol moiety, and borate moiety are believed to provide the basis for the synergistic antiwear activity. The phosphonate group and the boron moiety may additionally contribute significant anti-fatigue and/or high temperature stabilizing and/or cleanliness properties to this new class of additives. The hydroxyaryl group is also believed to contribute anti-oxidation with possible anti-corrosion and/or antirust and antistaining properties to these novel additives.

All of these beneficial properties are believed to be enhanced as a result of this novel internal synergism. This unique internal synergism concept is believed to be applicable to similar structures containing (a) phosphonate groups, (b) hydroxyaryl groups, (c) aminoalkanol groups, and (d) borate groups within the same molecule. The products of this patent application show good stability and compatibility when used in the presence of other commonly used additives in lubricant compositions.

DESCRIPTION OF THE PREFERRED EMBODIMENTS

Dihydrocarbyl hydrogen phosphonates (or dihydrocarbyl phosphites) were reacted with aminoalkanols and aldehydes/ketones via a Mannich condensation reaction to form phosphonate-derived aminoalkanols, as generally described below (Equation 1).

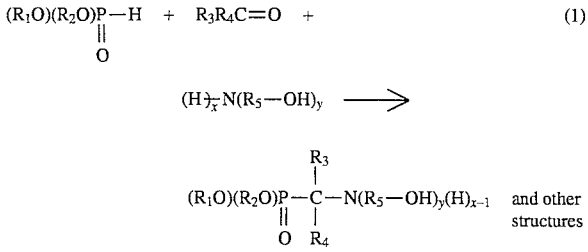

(1)

where $R_1$, $R_2$ are $C_1$ to $C_{30}$ hydrocarbyl; $R_3$, $R_4$ and $R_5$ are hydrogen, or $C_1$ to $C_{60}$ hydrocarbyl; x and y are the integers 1 or 2 and x+y=3.

The phosphonate-derived aminoalkanols were further reacted with hydroxyaryl containing, and boronating agents to form the mixed borates as outlined below (Equation 2).

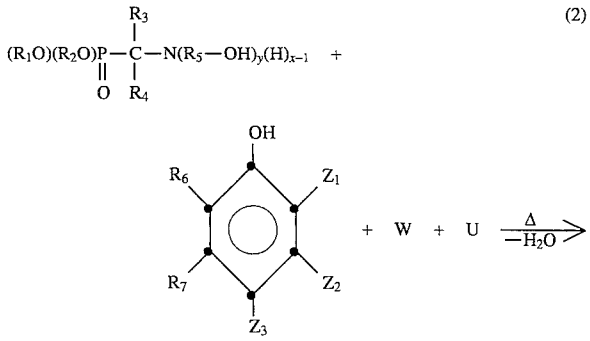

(2)

hydroxyaryl-phosphonate derived aminoalkanol mixed borates where $R_6$ and $R_7$ are each hydrogen or $C_1$to $C_{30}$hydrocarbyl, one or none of $Z_1$, $Z_2$, $Z_3$ is OH or the others are hydrogens or $C_1$ to $C_{60}$ hydrocarbyl; U is a coborating agent which possesses at least one hydroxy group having a structure like $R_8$—(—$OR_9$—)$_n$—OH where $R_8$ and $R_9$ are $C_1$ to $C_{30}$ hydrocarbyl, and n=0 to 20 (preferably $R_9$=$C_2$ to $C_6$); W is a borating agent, including, but not limited to, boric acid, boric oxide, meta borates, or a compound of the formula $(R_{10}O)_mB(OH)_p$ where $R_{10}$ is a $C_1$ to $C_{10}$ alkyl group, m is 0 to 3 and p is 0 to 3, their sum being 3. As indicated by the formula, included are boric acid and the alkyl borates such as mono-, di and trialkyl borates.

Any suitable $C_1$ to about $C_{60}$ hydrocarbyl aldehyde or ketone may be used herein. Preferred aldehydes include but are not limited to aldehydes such as formaldehyde, butyraldehyde, 2-ethyl hexanal and ketones such as acetone and methyl ethyl ketone. Any suitable $C_1$ to about $C_{60}$ hydrocarbyl hydrogen phosphite or phosphonate may be used, for example, such as dibutyl phosphite. Any suitable $C_1$ to about $C_{30}$ aminoalkanol such as diethanolamine may be used.

If a solvent is desired, any suitable hydrocarbon solvent such as toluene or the xylenes may be used.

Conditions for the above reactions may vary widely depending upon specific reactants, the presence or absence of a solvent and the like. Any suitable set of reaction conditions known to the art may be used. Generally, stoichiometric quantities of reactants are used. However, equimolar, more than molar or less than molar amounts may be used. An excess of one reagent or another can be used. Molar quantities, less than molar quantities, or more than molar quantities of a borating agent can be used. The reaction temperature may vary from ambient to about 250 ° C. or reflux, the pressure may vary from ambient or autogenous to about 500 psi and the molar ratio of reactants preferably varies from about 0.1 moles to about 10 moles for each individual reactant.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt. % based on the total weight of the composition can be used. Preferably, the concentration is from 0.1 to about 3 wt. %.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as, for example, from about 45 SSU at 100° F. to about 6000° SSU at 100° F. to about 6000 SSU at 100° F. and preferably, from about 50 to about 250 SSU at 210° F. These oils may have viscosity indexes ranging preferably to about 95. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylolpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers. Ester-based lubricants are highly suitable.

It is to be understood, however, that the compositions contemplated herein can also contain other materials. For example, corrosion inhibitors, extreme pressure agents, low temperature properties modifiers and the like can be used as exemplified respectively by metallic phenates or sulfonates, polymeric succinimides, non-metallic or metallic phosphorodithioates and the like. These materials do not detract from the value of the compositions of this invention, rather the materials serve to impart their customary properties to the particular compositions in which they are incorporated.

The following examples are merely illustrative and are not meant to be limitations.

EXAMPLE 1

Reaction Product of Dibutyl Phosphite, Formaldehyde and Diethanolamine

Into a four-necked flask equipped with a stirrer, condenser, dropping funnel and thermometer are added 210 g (2.0 moles) of diethanolamine and 170 g (2.1 moles) of aqueous formaldehyde and the contents are heated to 60° C. At that temperature, 388 g (2.0 moles) of dibutyl phosphite are added over a 15 minute period with agitation. After all of the phosphite reactant is introduced, the temperature is raised to 75° C. and held for one hour, then raised again to 105° C. and held for five additional hours. During this period, the water is azeotropically collected in the Dean-Stark trap, and at the end of the reaction, the volatiles are removed by vacuum distillation. Thereafter, the crude product is further filtered to give 614 g of dark brownish liquid.

EXAMPLE 2

Mixed Borates of Phosphite-Derived Aminodiethanol and Nonylphenol

Approximately 155.5 g (0.5 mole) of the above product of Example 1, 110.2 g (0.5 mole) of nonylphenol, 20.6 g (0.33 mole) of boric acid, and 200 ml of toluene were charged to a reaction vessel equipped with a condenser and a thermometer. This mixture was heated at 100°–110° C. for 8 hours, and water which formed was collected in the Dean-Stark trap (16 ml). Thereafter, the unreacted solids were filtered off and the organic filtrate was concentrated by removal of all the volatiles via distillation at reduced pressure to produce approximately 243 g of a viscous material.

EXAMPLE 3

Mixed Borates of Phosphite-Derived Aminodiethanol, tert-Butylcatechol and Neodol 25–3

Approximately 155.5 g (0.5 mole) of the above product of Example 1, 33.2 g (0.2 mole) of tert-butylcatechol, 84 g (0.125 mole) of triethoxylated mixed dodecanol-pentadecanol (commercially obtained from Shell Chemical Co. as Neodol 25-3), 20.7 g (0.33 mole) of boric acid, and 200 ml toluene were mixed together in a one-liter, four-neck reactor equipped with thermometer, nitrogen sparger, and Dean-Stark trap condenser and agitator. This mixture was refluxed by boiling toluene over a course of 6 hours, and 25.5 ml of water thus formed was collected in the Dean-Stark trap. Thereafter, the unreacted solids were filtered off and the organic filtrate was concentrated by removal of all the volatiles via distillation at reduced pressure to produce approximately 248 g of a viscous, dark material.

The mixed borates were blended into mixed mineral oil and evaluated for antiwear performance using the Four-Ball Wear test. As can be seen from the data in Table 1, the mixed hydroxyaryl-phosphonate-derived aminoalkanol borates exhibit significant antiwear properties.

The Four-Ball Wear Test was performed in accordance with ASTM D-2266; see, for example, U.S. Pat. No. 4,761,482 for a more complete description of the test.

TABLE 1

| Four-Ball Wear Test (30 min., 200° F.) | | |
|---|---|---|
| | Wear Scar Diameter (mm) | |
| Examples | 60 kg Load 2000 rpm | 40 kg Load 1800 rpm |
| Base oil (80% solvent paraffinic bright, 20% solvent paraffinic neutral mineral oils) | 4.02 | 0.731 |
| 1% of Example 2 in above base oil | 0.321 | — |
| 1% of Example 3 in above base oil | 2.41 | 0.508 |

The mixed borate was also blended into fully formulated oils and evaluated for load carrying performance using the Four-Ball EP test (TABLE 2).

TABLE 2

| Four-Ball EP Test (1760 rpm, 10 sec., 25° C.) | | | |
|---|---|---|---|
| Item | Last Non-Seizure Load (kg) | Weld Load (kg) | Load Weld Index (LWI) |
| Base oil (700 sus, fully formulated solvent refined paraffinic neutral oil containing anti-corrosion/antioxidant/anti-wear/EP/over-basing performance package) | 100 | 250 | 44.1 |
| Base oil plus 0.25% additional commercial EP additive (Anglamol 33) | 100 | 250 | 46.8 |
| Base oil plus 0.5% of Example 2 | 140 (126) | 250 | 52.4 |

*According to ASTM D2783 method; see U.S. Pat. No. 4,965,002 for a description of the test.

As shown above, the product of this invention shows considerable EP activity as evidenced by the improvement of Load Wear Index and micro-seizure load.

The use of additive concentrations of hydroxyaryl/phosphonate-derived aminoalkanol borates in premium quality automotive and industrial lubricants will significantly enhance the stability and load carrying capability, and reduce the wear. The novel compositions described in the instant invention are useful at low concentrations and do not contain any potentially undesirable metals, or chlorine.

What is claimed is:

1. An improved lubricant composition comprising a major amount of an oil of lubricating viscosity or grease prepared therefrom and a minor amount of a multifunctional antiwear/EP load-carrying additive product of reaction prepared by (a) reacting hydrocarbyl hydrogen phosphonates or phosphites with aminoalkanols and aldehydes/ketones via a Mannich condensation reaction to form phosphonate-derived aminoalkanols as described below:

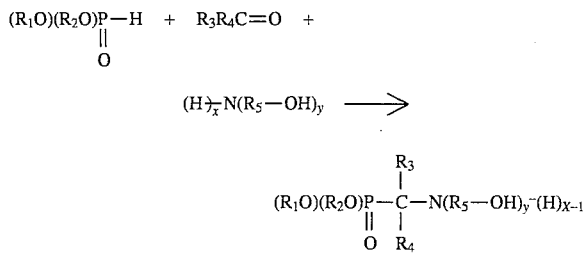

where $R_1$ and $R_2$ are $C_1$ to $C_{30}$ hydrocarbyl; $R_3$, $R_4$, and $R_5$ are hydrogen, or $C_1$ to $C_{60}$ hydrocarbyl and optionally contain sulfur, oxygen and/or nitrogen; x and y are the integers 1 or 2 and x+y=3; and (b) further reacting the resultant phosphonate-derived aminoalkanols with hydroxyaryl compounds and boronating agents to form mixed borates as described below:

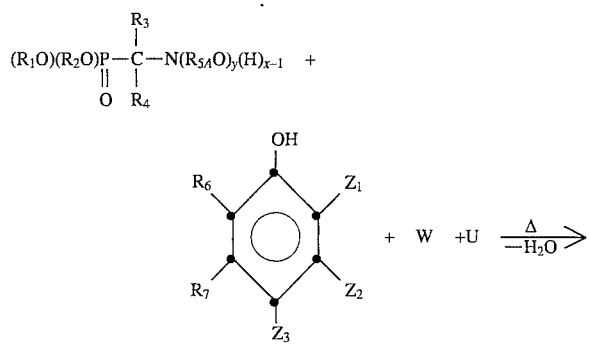

hydroxyaryl-phosphonate derived aminoalkanol mixed borates where $R_6$ and $R_7$ are hydrogen or $C_1$ to $C_{30}$ hydrocarbyl, and $Z_1$, $Z_2$ and $Z_3$ are hydrogen or $C_1$ to $C_{60}$ hydrocarbyl or one of $Z_1$, $Z_2$, or $Z_3$ is OH and the other two are hydrogen or $C_1$ to $C_{30}$ hydrocarbyl; U is a monoalkylphenol or a dialkyloxyphenol coborating agent with at least one hydroxy group having the structure $R_8$—($OR_9$—)$_n$—OH where $R_8$ and $R_9$ are $C_1$ to $C_{30}$ hydrocarbyl, and n=0 to 20, W is a borating agent, selected from a member of the group consisting of boric acid, boric oxide, meta borates, or a compound of the formula $(R_{10}O)_mB(OH)_p$ where $R_{10}$ is a $C_1$ to $C_{10}$ alkyl group, m is 0 to 3 and p is 0 to 3, their sum being 3; reactions (a) and (b) are carried out at temperatures varying from ambient to about 250° C. under pressure varying from ambient to about 500 psi for a time sufficient to obtain the product of reaction and where reaction (a) is carried out in molar ratios of reactants varying from, equimolar, to more than equimolar to less than equimolar and reaction (b) is carried out in molar quantities, less than molar quantities or more than molar quantities of the borating agent.

2. The composition of claim 1 wherein the reactants are dibutyl phosphite, formaldehyde, diethanolamine, nonylphenol and boric acid.

3. The composition of claim 1 wherein the reactants are dibutyl phosphite, formaldehyde, diethanolamine, tert-butylcatechol, triethoxylated mixed dodecanol-pentadecanol and boric acid.

4. The composition of claim 1 wherein the oil of lubricating viscosity is selected from the group consisting of (1) mineral oils, (2) synthetic oils, (3) and mixtures of mineral and synthetic oils the grease prepared from any one of (1), (2), and (3).

5. The composition of claim 4 wherein the said composition contains from about 0.001 to about 10 wt % based on the total weight of the composition of the additive product of reaction.

6. The composition of claim 5 wherein the lubricant oil is a mineral oil.

7. A process of preparing a multifunctional antiwear/EP additive product prepared by (a) reacting hydrocarbyl hydrogen phosphonates or phosphites with aminoalkanols and aldehydes/ketones via a Mannich condensation reaction to form phosphonate-derived aminoalkanols as described below:

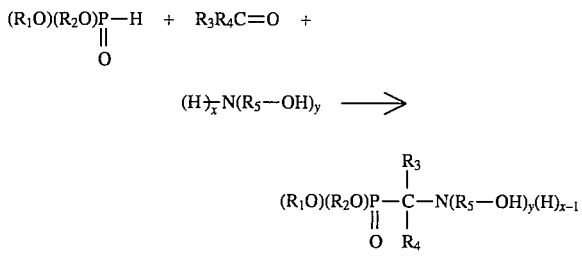

where $R_1$ and $R_2$ are $C_1$ to $C_{30}$ hydrocarbyl; R3, R4 and $R_5$ are hydrogen, or $C_1$ to $C_{60}$ hydrocarbyl and optionally contain sulfur, oxygen and/or nitrogen; x and y are the integers 1 or 2 and x+y=3; and (b) further reacting the resultant phosphonate-derived aminoalkanols with hydroxyaryl compounds and boronating agents to form mixed borates as described below:

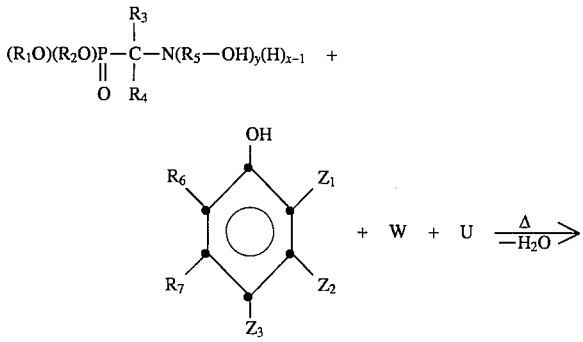

hydroxyaryl-phosphonate derived aminoalkanol mixed borates where $R_6$ and $R_7$ are hydrogen or $C_1$ to $C_{30}$ hydrocarbyl, and $Z_1$, $Z_2$ and $Z_3$ are hydrogen or $C_1$ to $C_{60}$ hydrocarbyl or one of $Z_1$, $Z_2$, or $Z_3$ is OH and the other two are hydrogen or $C_1$ to $C_{30}$ hydrocarbyl; U is a monoalkylphenol or a dialkyloxyphenol coborating agent with at least one hydroxy group having the structure $R_8$—($OR_9$—)$_n$—OH where $R_8$ and $R_9$ are $C_1$ to $C_{30}$ hydrocarbyl, and n=0 to 20, W is a borating agent, selected from a member of the group consisting of boric acid, boric oxide, meta borates, or a compound of the formula $(R_{10}O)_mB(OH)_p$ where $R_{10}$ is a $C_1$ to $C_{10}$ alkyl group, m is 0 to 3 and p is 0 to 3, their sum being 3; reactions (a) and (b) are carried out at temperatures varying from ambient to about 250° C. under pressure varying from ambient to about 500 psi for a time sufficient to obtain the product of reaction and where reaction (a) is carried out in molar ratios of reactants varying from, equimolar, to more than equimolar to less than equimolar and reaction (b) is carried out in molar quantities, less than molar quantities or more than molar quantities of the borating agent.

8. A multifunctional lubricant additive product of reaction prepared by (a) reacting hydrocarbyl hydrogen phosphonates or phosphites with aminoalkanols and aldehydes/ketones via a Mannich condensation reaction to form phosphonate-derived aminoalkanols as described below:

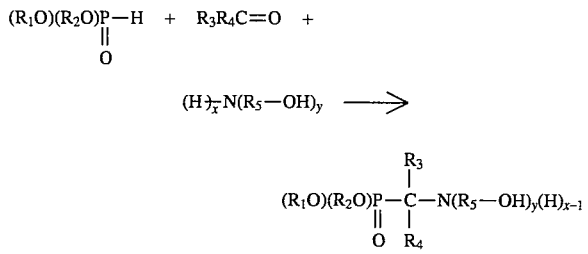

where $R_1$, and $R_2$ are $C_1$ to $C_{30}$ hydrocarbyl; $R_3$, $R_4$ and $R_5$ are hydrogen, or $C_1$ to $C_{60}$ hydrocarbyl and optionally contain sulfur, oxygen and/or nitrogen; x and y are the integers 1 or 2 and x+y=3; and (b) further reacting the resultant phosphonate-derived aminoalkanols with hydroxyaryl compounds and boronating agents to form mixed borates as described below:

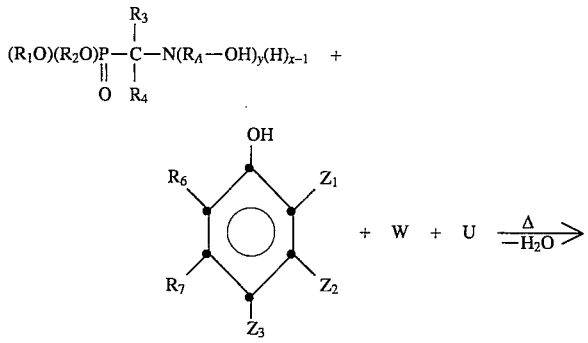

hydroxyaryl-phosphonate derived aminoalkanol mixed borates where $R_6$ and $R_7$ are hydrogen or $C_1$ to $C_{30}$ hydrocarbyl, and $Z_1$, $Z_2$ and $Z_3$ are hydrogen or Cto $C_{60}$ hydrocarbyl or one of $Z_1$, $Z_2$, or $Z_3$ is OH and the other two are hydrogen or $C_1$ to $C_{30}$ hydrocarbyl; U is a monoalkylphenol or a dialkyloxyphenol coborating agent with at least one hydroxy group having the structure $R_8$—($OR_9$—)$_n$—OH where $R_8$ and $R_9$ are $C_1$ to $C_{30}$ hydrocarbyl, and n=0 to 20, W is a borating agent, selected from a member of the group consisting of boric acid, boric oxide, meta borates, or a compound of the formula $(R_{10}O)_mB(OH)_p$ where $R_{10}$ is a $C_1$ to $C_{10}$ alkyl group, m is 0 to 3 and p is 0 to 3, their sum being 3; reactions (a) and (b) are carried out at temperatures varying from ambient to about 250° C. under pressure varying from ambient to about 500 psi for a time sufficient to obtain the product of reaction and where reaction (a) is carried out in molar ratios of reactants varying from, equimolar, to more than equimolar to less than equimolar and reaction (b) is carried out in molar quantities, less than molar quantities or more than molar quantities of the borating agent.

9. A method of preparing an improved lubricant composition comprising adding to a lubricating oil or grease thereof a minor multifunctional antiwear/EP load-carrying amount of from about 0.001 to about 10 wt % based on the total weight of the composition of the additive product of reaction of claim 8.

* * * * *